United States Patent [19]

Whitford

[11] Patent Number: 4,790,359

[45] Date of Patent: Dec. 13, 1988

[54] GAS INJECTION MEANS

[75] Inventor: Darryl R. Whitford, Angaston, Australia

[73] Assignee: S. Smith & Son Pty. Ltd., South Australia, Australia

[21] Appl. No.: 43,148

[22] Filed: Apr. 27, 1987

[30] Foreign Application Priority Data

May 2, 1986 [AU] Australia ..... PH5720

[51] Int. Cl.[4] ..... B65B 3/10

[52] U.S. Cl. ..... 141/67; 141/4; 222/3; 222/61; 222/399

[58] Field of Search ..... 141/4, 5, 9, 67; 222/3, 222/152, 399, 424.5, 61; 62/50, 51

[56] References Cited

U.S. PATENT DOCUMENTS

| | | | |
|---|---|---|---|
| 4,206,157 | 6/1980 | Plasmati | 137/91 X |
| 4,407,340 | 10/1983 | Jensen et al. | 141/67 |
| 4,499,931 | 2/1985 | Urban | 222/399 |
| 4,643,083 | 2/1987 | Boucher | 99/275 |

*Primary Examiner*—Stephen Marcus

*Attorney, Agent, or Firm*—Rodman & Rodman

[57] ABSTRACT

Injection means for injecting a liquified gas such as sulphur dioxide into a container such as a wine storage tank and avoiding "icing up" the valve mechanism, wherein a three limbed "T" piece of conduit receives the liquified gas, each having a separately controlled valve, one of the limbs being connected to a source of gas which is not liquified, such as nitrogen, the nitrogen blowing the liquified sulphur dioxide gas out of the three limbed "T" piece when two of the valves are opened. The volume of the "T" piece accurately determined the dosage of sulphur dioxide.

5 Claims, 2 Drawing Sheets

GAS INJECTION MEANS

This invention relates to injection means for the injecting of a liquified gas in small quantities into a container.

In various industries it is desirable that gas should be injected into a container, and for example in the wine industry it is desirable that very small quantities of sulphur dioxide should be carefully metered into a wine crusher or a tank. The requirements of certain health authorities limit the quantity of sulphur dioxide which can be used, but sulphur dioxide is very valuable as a preservative and it is therefore desirable that the quantity should be most accurately metered.

A number of attempts have been made in the past to provide a satisfactory metering means for metering small quantities of sulphur dioxide into a wine tank. However most of the attempts which have been made have not been satisfactory and the main object of this invention is to provide an improvement whereby small quantities can be metered, and wherein the gas, when expanding, does not "ice up" a valve mechanism.

In an embodiment of this invention, use is made of a three limbed "T-piece" of conduit having three limbs, power operated valve in each said limb, logic control means connected to the valves for the control of a sequence of operation thereof, a first said valve being connected by conduit means to a source of liquified gas which is to be injected into said container, a second said valve being connected by further conduit means to a source of other gas at the same pressure as said liquified gas, and the third said valve being connected by further conduit means to a source of other gas at the same pressure as said liquified gas to said container, said sequence of operation being arranged to open the first valve to allow flow of said liquified gas into said conduit 'T' piece then close the first valve but open the second valve to blow said liquified gas from the 'T' piece into the container.

An embodiment is described hereunder with reference to and is illustrated in the accompanying sketches in which.

Figure 1:
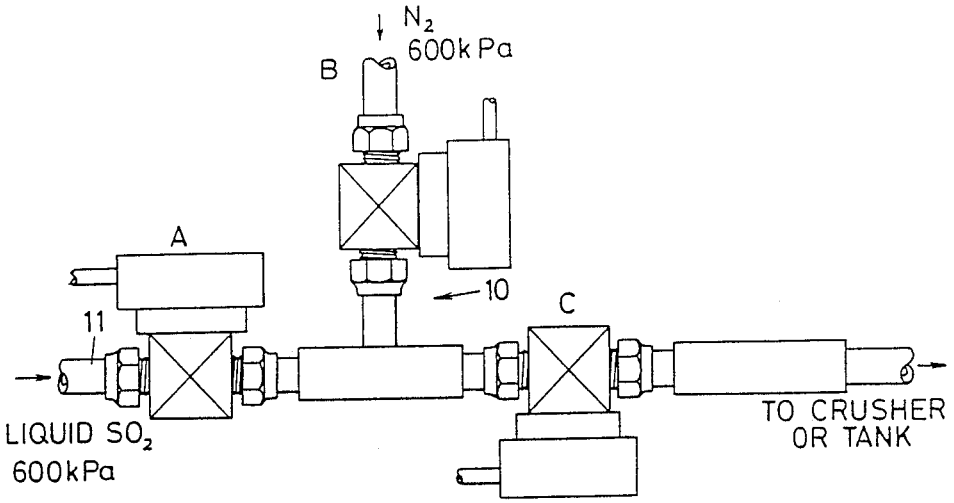
FIG. 1 is a diagrammatic representation of the T-piece and valve assembly.
Figure 3:
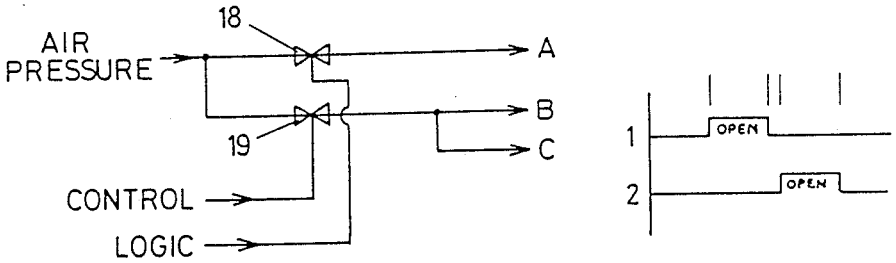
FIG. 3 is a diagrammatic representation of the control logic.

In this embodiment, the control logic of FIG. 3 is arranged to oscillate the valves designated A,B and C in the sequence which is shown in FIG. 1.

The first stage of oscillation is to shut all valves, and this is the normal situation.

In the second stage however valve A is opened so that liquid sulphur dioxide can flow under pressure into the limb of a T-piece 10 between the valves of A and C. The amount which flows into the T-piece 10 is accurately determined by the volume of the T-piece conduit and is repeatable within close limits. The liquid sulphur dioxide is held in its liquid state by the application of pressure, and this also assists gravity because at the stage when valve A is open (provided valve B is functioning correctly) there will be a slightly lower pressure in the T-piece 10 than in the liquid sulphur dioxide line 11.

Valve B connects to a source of nitrogen gas 12 which is held by non-return valve 13 and pressure reducing valve 14 at about the same pressure as the liquid sulphur dioxide in the line 11, but ensures the $N_2$ pressure is not less than the $SO_2$ pressure.

The next stage is to shut valve A, and open valves B and C. Since the delivery line 16 to the tank Mar crusher 18 is at much lower pressure than at 600 kPa, the nitrogen pressure quickly moves along the delivery line carrying with it sulphur dioxide, and as the sulphur dioxide vaporizes it does so in the delivery line over a wide area, and this avoids "icing up" of the valves.

The final stage four is for the valves A and B to be shut, and the valve C to be open so that once again low pressure is established in the T-piece 10.

Figure 2:
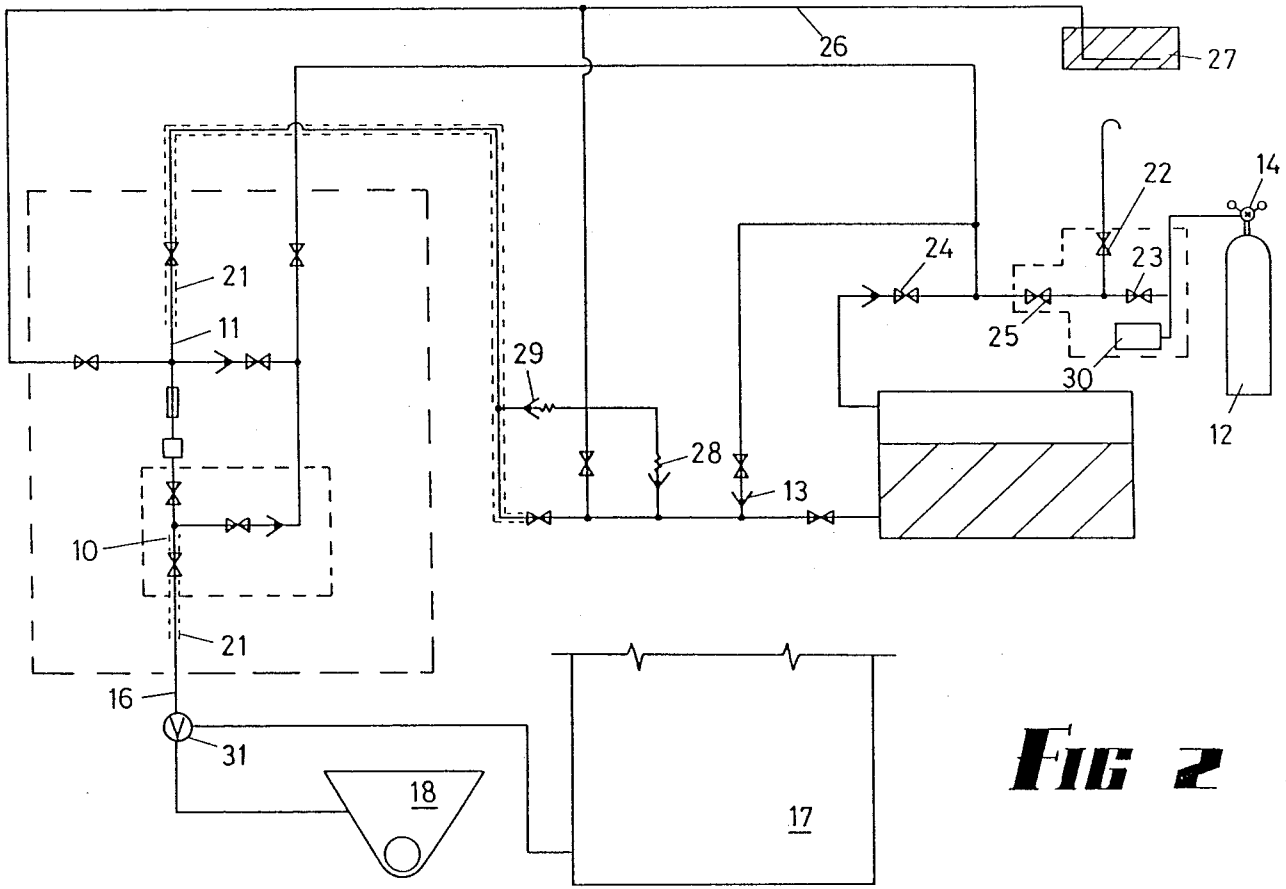
FIG. 2 is a diagram illustrating the pipe arrangement.

FIG. 2 illustrates the piping network used in this embodiment. Operation of each valve will be clear by glancing at the diagram. The lines 11 and 16 are preferably (but not always neccesarily) covered with insulation 21 to reduce danger of icing owing to evaporation of $SO_2$ liquid. Valves 22 and 23 enable exhaustion of nitrogen to be effected and valve 24 enables a manual operation to take place.

Line 26 is a vent line which terminates in a NaOH absorption bath 27, and relief valves 28 and 29 relieve overpressure of $SO_2$, while pressure switch 30 disables the entire network when the $N_2$ bottle is empty by closing valves 23 and 25 and opening valve 22.

Valve 31 directs the $SO_2/N_2$ mix either to tank 17 or crusher 18.

Other valves are merely venting and pumping valves.

The drawing of FIG. 3 illustrates diagrammatically the control valves 18 and 19 which control operation of the valves A, B, and C and also shows the air control logic for the circuit. Although air logic is preferred clearly an electrical equivalent using solenoid valves may be used. The intervals between operation of the valves determine the rate at which $SO_2$ enters the tank or crusher.

The cost of installation will be seen to be very small indeed, but the installation results in a very effective and accurate method of metering sulphur dioxide in a wine tank.

The claims defining the invention are claimed as follows:

1. Gas injection means for injecting small quantities of gas into a large container, comprising:

a conduit 'T' piece having three limbs, a respective power operated valve in each said limb, logic control means connected to the valves for the control of a sequence of operation thereof, a first source of liquified gas which is to be injected into said container, a first said power operated valve being connected by first conduit means to said first source of liquified gas, a second source of other gas at the same pressure as said liquified gas, a second said power operated valve being connected by second conduit means to said second source of other gas, and the third said power operated valve connected by third conduit means to said second source of other gas and to said container, said sequence of operation being arranged to open the first power operated valve to allow flow of liquified gas from said first source into the conduit 'T' piece, then close the first power operated valve but open the second power operated valve to blow said liquified gas from the 'T' piece through said third conduit means into the container.

2. Gas injection means according to claim 1 wherein said liquified gas in said first source is $SO_2$ and said other gas in said second source is $N_2$.

3. Gas injection means according to claim 2 comprising a fourth conduit between said first source of liquified gas and said second source of other gas and a non-return valve in said fourth conduit which ensures pressure of the $SO_2$ does not exceed pressure of the $N_2$.

4. Gas injection means according to claim 2 or claim 3 wherein said first, second and third power operated valves function in a four stage sequence, and at intervals which determine the rate at which the $SO_2$ is injected into the large container.

5. Gas injection means according to claim 2 or claim 3 comprising a pneumatic logic control coupled to said first, second and third power operated valves to operate said power operated valves in a four stage sequence, there being intervals between operation of the first, second and third power operated valves which determine the rate at which $SO_2$ is injected into the large container.

* * * * *